US010669635B2

(12) United States Patent
Monteiro et al.

(10) Patent No.: US 10,669,635 B2
(45) Date of Patent: Jun. 2, 2020

(54) METHODS OF COATING SUBSTRATES WITH COMPOSITE COATINGS OF DIAMOND NANOPARTICLES AND METAL

(71) Applicant: Baker Hughes Incorporated, a GE company, LLC, Houston, TX (US)

(72) Inventors: Othon R. Monteiro, Houston, TX (US); Oleg A. Mazyar, Katy, TX (US); Valery N. Khabashesku, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 223 days.

(21) Appl. No.: 14/490,214

(22) Filed: Sep. 18, 2014

(65) Prior Publication Data

US 2016/0083860 A1 Mar. 24, 2016

(51) Int. Cl.

| | |
|---|---|
| ***C23C 18/16*** | (2006.01) |
| ***C25D 15/00*** | (2006.01) |
| ***C25D 3/66*** | (2006.01) |

(52) U.S. Cl.

CPC ..... *C23C 18/1646* (2013.01); *C23C 18/1662* (2013.01); *C25D 3/665* (2013.01); *C25D 15/00* (2013.01)

(58) Field of Classification Search

CPC . C23C 18/1646; C23C 18/1662; C25D 3/665; C25D 15/00

See application file for complete search history.

(56) References Cited

U.S. PATENT DOCUMENTS

| | | | | |
|---|---|---|---|---|
| 3,617,347 | A | 11/1971 | Kuratomi | |
| 3,762,882 | A | 10/1973 | Grutza | |
| 3,980,549 | A | 9/1976 | Grutza | |
| RE33,767 | E * | 12/1991 | Christini | C23C 18/1651 427/305 |
| 5,164,220 | A | 11/1992 | Caballero | |
| 5,277,940 | A | 1/1994 | Caballero | |
| 5,496,463 | A | 3/1996 | Mori et al. | |
| 5,712,000 | A | 1/1998 | Wei et al. | |
| 5,967,400 | A | 10/1999 | Bell et al. | |
| 6,156,390 | A | 12/2000 | Henry et al. | |

(Continued)

FOREIGN PATENT DOCUMENTS

| | | | |
|---|---|---|---|
| CN | 1380363 | A | 11/2002 |
| CN | 101029359 | A | 9/2007 |

(Continued)

OTHER PUBLICATIONS

The Free Dictionary, "Steel", 2015, p. 1-6.*

(Continued)

*Primary Examiner* — Katherine A Bareford
*Assistant Examiner* — Christina D McClure
(74) *Attorney, Agent, or Firm* — TraskBritt

(57) ABSTRACT

A method of coating a substrate includes dispersing functionalized diamond nanoparticles in a fluid comprising metal ions to form a deposition composition; disposing a portion of the deposition composition over at least a portion of a substrate; and electrochemically depositing a coating over the substrate. The coating comprises the diamond nanoparticles and a metal formed by reduction of the metal ions in the deposition composition.

18 Claims, 4 Drawing Sheets

(56) References Cited

U.S. PATENT DOCUMENTS

| | | | | |
|---|---|---|---|---|
| 6,258,237 | B1 * | 7/2001 | Gal-Or | C23C 16/045 204/450 |
| 6,286,498 | B1 | 9/2001 | Sung | |
| 6,638,570 | B2 | 10/2003 | Veerasamy | |
| 6,752,709 | B1 | 6/2004 | Skibo et al. | |
| 7,201,972 | B2 | 4/2007 | Shiozaki et al. | |
| 7,820,130 | B2 | 10/2010 | Khabashesku et al. | |
| 7,858,186 | B2 | 12/2010 | Khabashesku et al. | |
| 9,803,283 | B1 * | 10/2017 | Martin | C23C 18/1687 |
| 9,873,827 | B2 | 1/2018 | Chakraborty et al. | |
| 2003/0220204 | A1 | 11/2003 | Baran, Jr. et al. | |
| 2003/0228249 | A1 * | 12/2003 | Fujimura | C25D 15/02 423/446 |
| 2004/0191545 | A1 * | 9/2004 | Han | C23C 16/4404 428/472 |
| 2005/0016863 | A1 * | 1/2005 | Hwang | B82Y 30/00 205/316 |
| 2005/0121417 | A1 * | 6/2005 | Dixon | A61F 2/30767 216/88 |
| 2005/0287952 | A1 * | 12/2005 | Ryan | H01L 23/3735 455/63.1 |
| 2006/0169450 | A1 | 8/2006 | Mang | |
| 2006/0269467 | A1 * | 11/2006 | Khabashesku | B05D 1/185 423/446 |
| 2007/0126312 | A1 | 6/2007 | Sung | |
| 2007/0158619 | A1 | 7/2007 | Wang et al. | |
| 2007/0199826 | A1 | 8/2007 | Son et al. | |
| 2007/0298669 | A1 | 12/2007 | Barrera et al. | |
| 2009/0155479 | A1 | 6/2009 | Xiao et al. | |
| 2009/0211758 | A1 | 8/2009 | Bragg | |
| 2009/0242414 | A1 | 10/2009 | Welz-Biermann et al. | |
| 2010/0019456 | A1 | 1/2010 | Gerrard | |
| 2010/0028675 | A1 | 2/2010 | Gogotsi et al. | |
| 2010/0096139 | A1 | 4/2010 | Holcomb et al. | |
| 2010/0243248 | A1 | 9/2010 | Golomb et al. | |
| 2011/0024299 | A1 * | 2/2011 | Reusmann | C25D 15/00 205/50 |
| 2011/0108269 | A1 | 5/2011 | Van Den Berg et al. | |
| 2011/0278002 | A1 | 11/2011 | McGuire | |
| 2012/0148762 | A1 | 6/2012 | Wei et al. | |
| 2012/0175534 | A1 | 7/2012 | Jung et al. | |
| 2012/0181029 | A1 | 7/2012 | Saini et al. | |
| 2012/0245058 | A1 | 9/2012 | Monteiro et al. | |
| 2012/0285690 | A1 | 11/2012 | Weaver et al. | |
| 2013/0045897 | A1 | 2/2013 | Chakraborty et al. | |
| 2013/0081335 | A1 * | 4/2013 | Mazyar | C01B 31/06 51/309 |
| 2013/0165353 | A1 * | 6/2013 | Mazyar | B82Y 30/00 507/219 |
| 2013/0341022 | A1 | 12/2013 | Nguyen et al. | |
| 2014/0096964 | A1 | 4/2014 | Chakraborty et al. | |
| 2014/0187449 | A1 | 7/2014 | Khabashesku et al. | |
| 2014/0290958 | A1 | 10/2014 | Marr et al. | |
| 2015/0047847 | A1 | 2/2015 | Mazyar et al. | |
| 2015/0175807 | A1 | 6/2015 | Jing et al. | |
| 2015/0225655 | A1 | 8/2015 | Adams et al. | |
| 2015/0368539 | A1 | 12/2015 | Tour et al. | |

FOREIGN PATENT DOCUMENTS

| | | | |
|---|---|---|---|
| CN | 102304737 | A | 1/2012 |
| CN | 102354609 | A | 2/2012 |
| CN | 102560415 | A | 7/2012 |
| CN | 102719693 | A | 10/2012 |
| CN | 102329976 | B | 1/2013 |
| EP | 1826294 | A1 | 8/2007 |
| JP | 62072511 | A | 4/1987 |
| JP | 04157157 | A | 5/1992 |
| JP | 2798523 | B2 | 9/1998 |
| JP | 2006225730 | A | 8/2006 |
| JP | 5010945 | B2 | 8/2012 |
| JP | 2012200989 | A | 10/2012 |
| KR | 1020080093625 | A | 10/2008 |
| KR | 10-2009-0001161 | A | 1/2009 |
| KR | 10-2009-0010406 | A | 1/2009 |
| KR | 1020120027350 | A | 3/2012 |
| KR | 1020130002085 | A | 1/2013 |
| WO | 0075394 | A1 | 12/2000 |
| WO | 2007/148667 | A1 | 12/2007 |
| WO | 2016/064568 | A1 | 4/2016 |

OTHER PUBLICATIONS

Helmenstine, T., Periodic Table of the Elements, 2014, Chemistry. About.Com, p. 1.*

Lou, H., Huang, Y., "Electroplating", 2006, Encyclopedia of Chemical Processing, Taylor & Francis, p. 1-10.*

Agrawal et al., U.S. Appl. No. 14/744,520, filed Jun. 19, 2015, and titled Methods and Suspensions for Recovery of Hydrocarbon Material From Subterranean Formations.

Alvarado et al., Enhanced Oil Recovery: An Update Review, Energies, vol. 3, (2010), pp. 1529-1575.

Bryant et al., Development of Nanoparticle-Stabilized Foams to Improve Performance of Water-less Hydraulic Fracturing, Quarterly Progress Report, Oct. 1, 2013-Dec. 13, 2013, 16 pages.

Chakraborty et al., U.S. Appl. No. 14/519,496, filed Oct. 21, 2014, and titled Suspensions for Enhanced Hydrocarbon Recovery, and Methods of Recovering Hydrocarbons Using the Suspensions.

Drexler et al., Amphiphilic Nanohybrid Catalysts for Reactions at the Water/Oil Interface in Subsurface Reservoirs, Energy & Fuels, vol. 26, (2012), pp. 2231-2241.

Kuznetsov et al., U.S. Appl. No. 14/289,838, titled Methods of Obtaining a Hydrocarbon Material From a Mined Material, and Related Stabilized Emulsions, filed May 29, 2014.

Kuznetsov et al., U.S. Appl. No. 14/296,857, titled Flocculants and methods for Recovering Bitumen From Oil Sands, filed Jun. 5, 2014.

Luu et al., Nanoparticles Adsorbed at the Water/Oil Interface: Coverage and Composition Effects on Structure and Diffusion, American Chemical Society, Langmuir, vol. 29, (2013), pp. 7221-7228.

Mcelfresh et al., Application of Nanofluid Technology to Improve Recovery in Oil and Gas Wells, Society of Petroleum Engineers, (2012), SPE 154827, 6 pages.

Shen et al., Emulsions Stabilized by Carbon Nanotube-Silicon Nanohybrids, Languir, vol. 25, No. 18, (2009), pp. 10843-10851.

Suresh et al., U.S. Appl. No. 14/530,205 entitled, Compositions of Coated Diamond Nanoparticles, Methods of Forming Coated Diamond Nanoparticles, and Methods of Forming Coatings, filed Oct. 31, 2014.

Suresh et al., U.S. Appl. No. 14/169,432, filed Jan. 31, 2014, and titled NANO-Surfactants for Enhanced Oil Recovery, and Methods of Forming and Using Such NANO-Surfactants.

Suresh et al., U.S. Appl. No. 14/289,873, filed May 29, 2014, and titled Suspensions Including Organic Bases for Enhanced Oil Recovery and Methods of Obtaining Hydrocarbons Using Such Suspensions.

Wasan et al., Spreading of Nanofluids on Solids, Nature, vol. 423, May 8, 2003, pp. 156-159.

Xue et al., Functionalization of Graphene Oxide with Polyhedral Oligomeric Silsesquioxane (POSS) for Multifunctional Applications, Journal of Physical Chemistry Letters, vol. 3 (2012), pp. 1607-1612.

Chang et al., Electrodeposition of Aluminum on Magnesium Alloy in Aluminum Chloride (AlCl3)-1-Ethyl-3-Methylimidazolium Chloride (EMIC) Ionic Liquid and its Corrosion Behavior, Electrochemistry Communications, vol. 9, (2007), pp. 1602-1606.

Liu et al., Functionalization of Nanoscale Diamond Powder: Fluoro-, Alkyl-, Amino-, and Amino Acid-Nanodiamond Derivatives, Chem. Mater. vol. 16, (2004), pp. 3924-3930.

Simka et al., Electrodeposition of Metals from Non-Aqueous Solutions, Electrochimica Acta, vol. 54, (2009), pp. 5307-5319.

Tsuda et al., Electrochemical Applications of Room-Temperature Ionic Liquids, The electrochemical Society Interface, Spring 2007, pp. 42-49.

Underwood, Ervin E., Quantitative Stereology, Addison Wesley Publishing Company, Inc., (1970), pp. 80-109.

(56) References Cited

OTHER PUBLICATIONS

Wu et al., Functionalization of Carbon Nanotubes by an Ionic-Liquid Polymer: Dispersion of Pt and PtRu Nanoparticles on Carbon Nanotubes and Their Electrocatalytic Oxidation of Methanol**, Angew. Chem. Int. Ed., vol. 48, (2009), pp. 4751-4754.
International Search Report for International Application No. PCT /US2015/049997 dated Dec. 7, 2015, 3 pages.
International Written Opinion for International Application No. PCT /US2015/049997 dated Dec. 7, 2015, 6 pages.
Tsubota et al., Composite Electroplating of Ni and Surface-Modified Diamond Particles with Silane Coupling Regent, Diamond & Related Materials, vol. 14, No. 3/7, Mar.-Jul. 2005, pp. 608-612.
Jee et al., Surface Functionalization and Physicochemical Characterization of Diamond Nanoparticles, Current Applied Physics, vol. 9, No. 2, Mar. 2009, pp. e144-e147.
Krueger, Anke, "The structure and reactivity of nanoscale diamond," Journal of Materials Chemistry, 2008, vol. 18, pp. 1485-1492.
Lou et al., Electroplating, Encyclopedia of Chemical Processing, Taylor & Francis, (2006), pp. 1-10.
Strauss et al., Carbon Nanodots—Towards a Comprehensive Understanding of their Photoluminescense, Journal Nov. 4, 2014, 11 pages, American Chemical Society, Washington DC.
Neuman et al.; Silica Encapsulation of Fluorescent Nanodiamond for Colloidal Stability and Facile Surface Functionalization; J. Am.Chem. Soc.; 135, 7815-7818; 2013.
Li et al., Carbon nanodots: synthesis, properties and applications, Journal, Dec. 14, 2012, p. 24175-24478, vol. 22, No. 46, J. Mater. Chem.
Kwon et al., Control of Photoluminescence of Carbon Nanodots via Surface Functionalization using Para-substituted Anilines, Sci. Rep. 5, 12604; doi: 10.1038/srep12604 (2015), p. 1-10.
Krueger, New Carbon Materials: Biological Applications of Functionalized Nanodiamond Materials: Chem. Eur. J.: 14, 1382-1390: 2008.
Baker et al., Luminescent Carbon Nanodots: Emergent Nanolights, Angew. Chem. Int. Ed., vol. 49, (2010), pp. 6726-6744.
Alkoxy definition, Wiktionary.org, https://en.wiktionary.org/w/index.php?title=alkoxy&oldid=47708692, retreived from Web Jan. 23, 2018.
"Mixture." Merriam-Webster.com. Merriam-Webster, n.d. Web. Dec. 21, 2017. (Year: 2017).
"Alkoxysilane" definition, Wiktionary.org, https://en.wiktionary.org/w/index.php?title=alkoxysilane&oldid=42021502, retreived from Web Jan. 23, 2018.

* cited by examiner

Formula (1)

Formula (5)

Formula (8)

Formula (2)

Formula (6)

Formula (9)

Formula (3)

Formula (4)

Formula (7)

Formula (10)

Formula (12)

Formula (15)

Formula (13)

METHODS OF COATING SUBSTRATES WITH COMPOSITE COATINGS OF DIAMOND NANOPARTICLES AND METAL

CROSS-REFERENCE TO RELATED APPLICATIONS

The subject matter of this application is related to the subject matter of U.S. patent application Ser. No. 14/744,520, filed Jun. 19, 2015; U.S. patent application Ser. No. 14/530,205, filed Oct. 31, 2014; and U.S. patent application Ser. No. 14/519,496, filed Oct. 21, 2014.

FIELD

Embodiments of the present disclosure relate generally to composite coatings and methods of forming such coatings, which may be used, for example, to improve the performance of substrates, such as in pumps and other wellbore equipment.

BACKGROUND

To combat the effects of wear-intensive or corrosively inhospitable environments, equipment and tools are commonly coated with protective coatings. In particular, hard coatings can be included on equipment and tools to improve wear characteristics and prolong the lifetime of the tools. Such hard coatings include various ceramics or metals. Polymer coatings may be used to protect from corrosion. Typical polymeric coatings can fail at elevated temperatures or under high load, and metal coatings still are lacking in certain aspects such as strength-to-weight ratio.

Therefore, coatings having improved mechanical properties that can protect or enhance the performance of components and tools would be beneficial.

BRIEF SUMMARY

In some embodiments, a method of coating a substrate includes dispersing functionalized diamond nanoparticles in a fluid comprising metal ions to form a deposition composition; disposing a portion of the deposition composition over at least a portion of a substrate; and electrochemically depositing a coating over the substrate. The coating comprises the diamond nanoparticles and a metal formed by reduction of the metal ions in the deposition composition.

In some embodiments, a method of coating a substrate includes disposing a deposition fluid in a container and disposing a surface of a substrate in the container in contact with the deposition fluid and electrochemically depositing a coating on the substrate. The deposition fluid comprises a plurality of functionalized diamond nanoparticles and a plurality of metal ions. The coating comprises a metal formed from the metal ions and the functionalized diamond nanoparticles.

In other embodiments, a method includes disposing a deposition fluid in a container, disposing at least a portion of a substrate in the container in contact with the deposition composition, and electrochemically forming a coating on the substrate. The deposition fluid includes a plurality of functionalized diamond nanoparticles, an ionic liquid, and metal ions. The coating includes a metal formed from the metal ions and the functionalized diamond nanoparticles.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
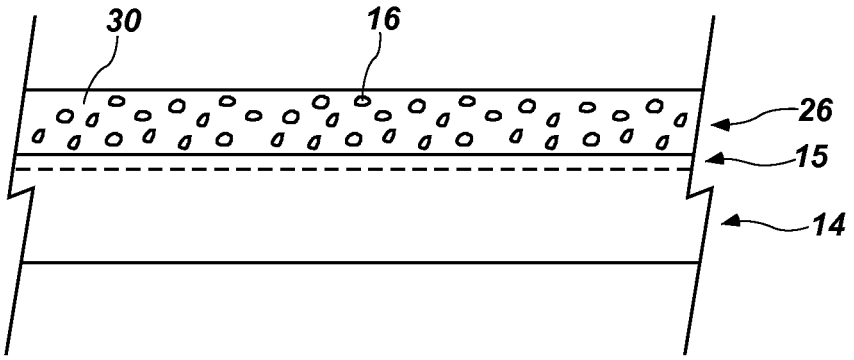
FIG. 1 is a simplified cross-sectional side view of a substrate and a coating thereon.

The illustrations presented herein are not meant to be actual views of any particular material, apparatus, system, or method, but are merely idealized representations employed to describe certain embodiments. For clarity in description, various features and elements common among the embodiments may be referenced with the same or similar reference numerals.

As used herein, the term "grain size" means and includes a geometric mean diameter of grains measured from a two-dimensional section through a bulk polycrystalline material. The geometric mean diameter of grains may be determined using techniques known in the art, such as those set forth in Ervin E. Underwood, QUANTITATIVE STEREOLOGY, 103-105 (Addison Wesley Publishing Company, Inc., 1970), the disclosure of which is incorporated herein in its entirety by this reference.

As used herein, the term "particle size" means and includes a largest linear dimension of a particle (sometimes referred to as "diameter"). As used herein, "average size" and "average particle size" refer to the number-average particle size based on the largest linear dimension of each particle of a group of particles. Particle size, including average, maximum, and minimum particle sizes, may be determined by an appropriate method of sizing particles such as, for example, static or dynamic light scattering (SLS or DLS) using a laser light source, physical classification such as screening, or any other appropriate method. Accurate measurement of particle sizes may depend on the size range of the particles to be measured.

As used herein, the term "nanoparticle" means and includes a particle having a particle size of less than 1 μm (i.e., less than 1000 nm). As used herein, the terms "nanodiamond" and "diamond nanoparticle" each mean and include nanoparticles of diamond.

As used herein, "aqueous fluid" means and includes a fluid that includes water, an alcohol (monohydric such a $C_1$-$C_4$ alcohol or polyhydric such as glycols), a carboxylic acid (e.g., formic acid, acetic acid, etc.), or a combination thereof. "Non-aqueous fluids" are fluids that primarily include fluids other than water, alcohols, or carboxylic acids. As used herein, the term "solvents," whether aqueous or non-aqueous, means and includes fluids capable of dissolving solutes.

A metal matrix composite including nanoparticles (e.g., diamond nanoparticles) and metal may form a coating with beneficial properties. The coating may be lightweight, magnetic or nonmagnetic, strong, and hard. The coating may also have advantageous barrier properties, selectable permeability, and a coefficient of friction that is reduced compared to metal coatings without nanodiamond. Moreover, the metal matrix composite may have a composition and microstructure that is configurable at the micro- or nanoscale to control its material, chemical, or physical properties. Furthermore, the metal matrix composite herein can be made by electrodeposition, such as electroless deposition or electroplating.

FIG. 1 illustrates a substrate 14 having a coating 26 formed thereon. The substrate 14 may be electrically conductive or electrically nonconductive. Electrically conductive substrates include metals and alloys or composites thereof. Examples of metals include aluminum, bismuth, boron, calcium, cobalt, copper, chromium, iron, lead, magnesium, manganese, molybdenum, nickel, niobium, nitrogen, phosphorous, selenium, sulfur, tantalum, tellurium, titanium, tungsten, vanadium, zirconium, silicon, zinc, a rare earth element, or a combination or alloy thereof. Examples of alloys include nickel-cobalt, ferrous alloys, magnesium alloys (e.g., Mg—Al alloys, MgZrZn, MgAlZn, etc.), aluminum alloys, etc.

In some embodiments, the substrate 14 may be electrically nonconductive (e.g., a polymer, ceramic, glass, etc.). An electrically nonconductive substrate may include a strike layer 15 comprising an electrically conductive material (e.g., a metal) disposed on a surface of the substrate 14. The strike layer 15, if present, may cover all or a portion of the substrate 14. In some embodiments, the substrate 14 may not include a strike layer 15. The substrate 14 may have any shape (e.g., planar, round, mesh, polygonal, rectangular, annular, etc.), and may be smooth or rough. The substrate 14 may have an edge such as a corner, break, hole, pore, etc.

The coating 26 (also referred to as a metal matrix nanocomposite) includes nanoparticles 16 dispersed in a matrix of metal 30. The coating 26 is disposed on the substrate 14.

In some embodiments, a method for coating a substrate 14 includes dispersing functionalized nanoparticles 16 (e.g., diamond nanoparticles) in a fluid comprising metal ions to form a mixture; disposing a portion of the mixture over at least a portion of a substrate; and electrochemically depositing a coating 26 over the substrate 14. The coating 26 includes the nanoparticles 16 and a metal 30 formed by reduction of metal ions in the mixture.

Figure 2:
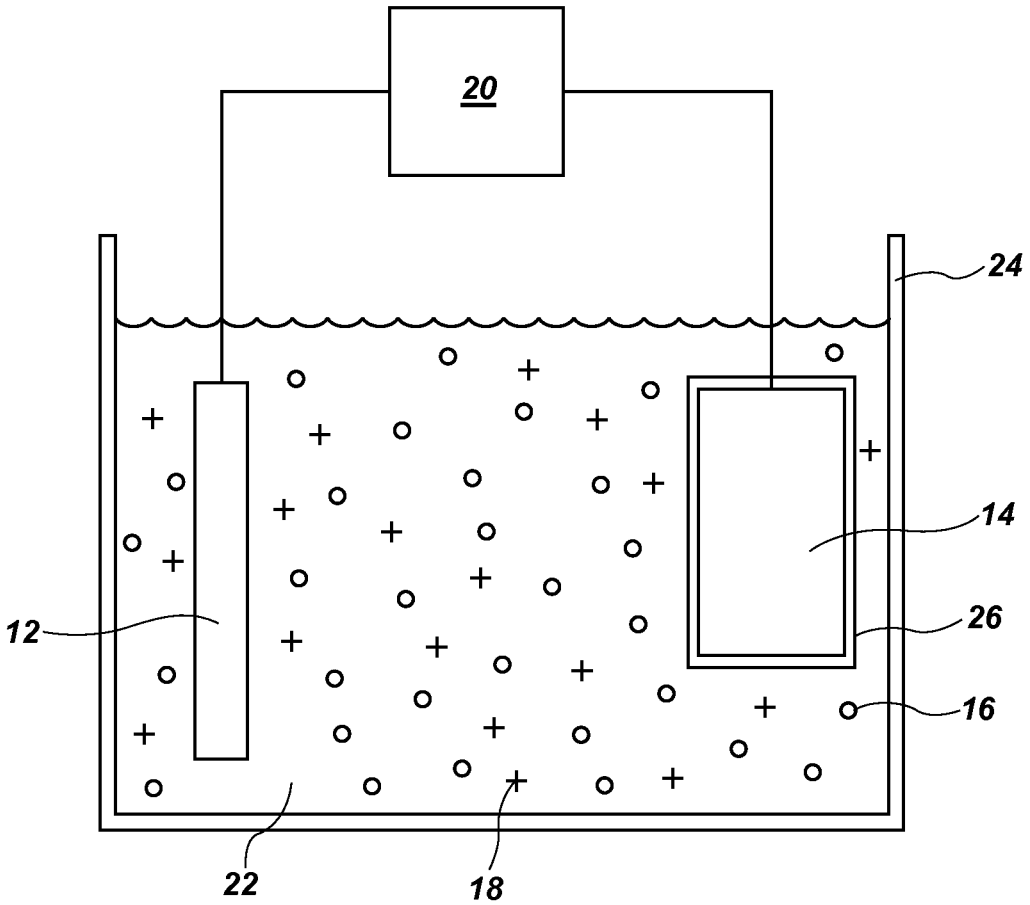
FIG. 2 is a simplified cross-sectional side view illustrating a method of forming a coating on a substrate by electroplating.

The substrate 14 may be biased with an electrical potential for depositing the metal 30 and nanoparticles 16 thereon. That is, the substrate 14 may be a cathode. As shown in FIG. 2, the substrate 14, which may function as a cathode in an electroplating process, may be disposed in a container 24 and electrically connected to a power supply 20. A deposition fluid 22 having nanoparticles 16 (e.g., diamond nanoparticles) and metal ions 18 may be disposed in the container 24 with the substrate 14. The deposition fluid 22 may be a mixture or suspension of the nanoparticles 16 in one or more liquid phases. An anode 12 may be connected to the power supply 20. The voltage is applied between the anode 12 and the substrate 14 so that the potential of the substrate 14 is lower than the potential of the anode 12. Under such an applied voltage, the nanoparticles 16 and a metal 30 (see FIG. 1) formed from the metal ions 18 in the deposition fluid 22 deposit on the substrate 14 to form the coating 26. The coating 26 may be continuously formed, without stopping the applied voltage, and without forming the coating layer-by-layer. In some embodiments, the coating 26 may be formed in a plurality of discrete applications of the voltage (e.g., to form the coating 26 to have layers of differing compositions).

The deposition fluid 22 provides nanoparticles 16 and the metal 30 deposited as the coating 26. In particular, metal ions 18 in the deposition fluid 22 may provide a source of the metal 30 deposited on the substrate 14. The metal ions 18 may include any compound that contains the metal ions 18 such that at least some of the metal ions 18 in the compound are reduced to yield an elemental metal. Such a compound may include, for example, covalent compounds of the metal, ionic compounds of the metal, metal complexes, etc. Examples of compounds include, without limitation, $AlCl_3$, $NiCl_2$, $NiSO_4$, $CoSO_4$, $Ni((C_6H_5)_3P)_2(SCN)_2$, $Ni((C_6H_5)_3P)_2(NO_3)_2$, $Ni(NH_2CH_2CH_2NH_2)_2(NO_3)_2$, $Ni(NH_2CH_2CH_2NH_2)_2(NO_3)I$, $Co((C_6H_5)_3PO)_2(NO_3)_2$, $Co(NH_3)_4(CO_3)(NO_3)$, $Ni(C_5H_5N)_3(NO_3)_2$, $Co(C_5H_5N)_3(NO_3)_2$, $Cu(NO_3)_2$, $AuCl_3$, etc. In ionic compounds, the anion may be a halide (e.g., fluoride, chloride, bromide), sulfate, sulfite, sulfamate, acetate, nitrate, hydroxide, cyanide, chromate, carbonate, phosphate, ammonium, perchlorate, etc. Upon reduction, the metal released from the compound and deposited on the substrate 14 with the nanoparticles 16 may include Al, Co, Ni, Cu, Ag, Au, Cr, Fe, Pb, Pd, Pt, Rh, Ru, Sn, Ti, V, W, Zn, or any combination thereof.

The anode 12, if present, may include the same metal as the metal 30 produced from reduction of metal ions 18 in the deposition fluid 22. During deposition of the metal 30 and nanoparticles 16 on the substrate 14, the anode 12 releases the metal into the deposition fluid 22 so that the amount of the metal ions 18 (and/or metallic species) in the deposition fluid 22 is not depleted. In some embodiments, additional metal ions 18 from an external source (e.g., a metal ion source such as a metering pump, flow meter, etc.) may be provided to the deposition fluid 22 to establish a selected (e.g., constant or varying) concentration of the metal ions 18 in the deposition fluid 22 as the metal ions 18 are consumed in the deposition process to form the coating 26.

In some embodiments, the nanoparticles 16 have a particle size in a range from about 20 nm to about 1000 nm (1 μm), such as from about 30 nm to about 750 nm, from about 40 nm to about 500 nm, or from about 50 nm to about 250 nm. For example, nanoparticles 16 may have a particle size from about 20 nm to about 100 nm. The nanoparticles 16 may be monodisperse (i.e., substantially all particles of approximately the same size with little variation) or polydisperse (i.e., the particles having a relatively wide range of sizes). In some embodiments, nanoparticles 16 of different average particle sizes are used. Thus, the particle size distribution of the nanoparticles 16 may be unimodal (exhibiting a distribution having a single peak in a plot of the number of particles versus particle size), bimodal (two peaks), or multi-modal (multiple peaks).

In some embodiments, nanoparticles 16 are derivatized to include a variety of different functional groups, such as carboxy (e.g., carboxylic acid groups), epoxy, ether, ketone, amine, hydroxy, alkoxy, alkyl, aryl, aralkyl, alkaryl, lactone, functionalized polymeric or oligomeric groups, etc. The nanoparticles 16 may include a combination of derivatized nanoparticles and underivatized nanoparticles. The functional groups may be added by, for example, covalently bonding one or more molecular groups to outer surfaces of the nanoparticles 16. For example, functional groups may be added by methods described in Yu Liu, et al., "Functionalization of Nanoscale Diamond Powder: Fluoro-, Alkyl-, Amino-, and Amino Acid-Nanodiamond Derivatives," 16 Chem. Mater. 3924-3930 (2004), the entire contents of which are hereby incorporated by reference.

Nanoparticles 16 may be derivatized to include a functional group that is hydrophilic, hydrophobic, oxophilic, lipophilic, or oleophilic to provide a balance of desirable properties.

In certain embodiments, the nanoparticles are derivatized by, for example, amination to include amine groups, where amination may be accomplished by nitration followed by reduction, or by nucleophilic substitution of a leaving group by an amine, substituted amine, or protected amine, followed by deprotection as necessary. In another embodiment, the nanoparticles are derivatized by oxidative methods to produce an epoxy, hydroxy group or glycol group using a peroxide, or by cleavage of a double bond by, for example, a metal mediated oxidation such as a permanganate oxidation to form ketone, aldehyde, or carboxylic acid functional groups.

If the functional groups are alkyl, aryl, aralkyl, alkaryl, functionalized polymeric or oligomeric groups, or a combination of these groups, the functional groups may be attached to the nanoparticles 16 through intermediate functional groups (e.g., carboxy, amino). In some embodiments, the functional groups may be attached directly to the derivatized nanoparticle by: a carbon-carbon bond without intervening heteroatoms (which may provide greater thermal and/or chemical stability to the derivatized nanoparticle, as well as a more efficient synthetic process requiring fewer steps); a carbon-oxygen bond (if the nanoparticle contains an oxygen-containing functional group such as hydroxy or carboxylic acid); or a carbon-nitrogen bond (if the nanoparticle contains a nitrogen-containing functional group such as amine or amide). In an embodiment, the nanoparticles are derivatized by metal mediated reaction with a $C_{6-30}$ aryl or $C_{7-30}$ aralkyl halide (F, Cl, Br, I) in a carbon-carbon bond forming step, such as by a palladium-mediated reaction such as the Stille reaction, Suzuki coupling, or diazo coupling, or by an organocopper coupling reaction.

In another embodiment, nanoparticles 16 are directly metallated by reaction with, e.g., an alkali metal such as lithium, sodium, or potassium, followed by reaction with a $C_{1-30}$ alkyl or $C_{7-30}$ alkaryl compound with a leaving group such as a halide (Cl, Br, I) or other leaving group (e.g., tosylate, mesylate, etc.) in a carbon-carbon bond forming step. The aryl or aralkyl halide, or the alkyl or alkaryl compound, may be substituted with a functional group such as hydroxy, carboxy, ether, etc. Examples of groups include, for example, hydroxy groups, carboxylic acid groups, alkyl groups such as methyl, ethyl, propyl, butyl, pentyl, hexyl, octyl, dodecyl, octadecyl, etc.; aryl groups including phenyl and hydroxyphenyl; alkaryl groups such as benzyl groups attached via the aryl portion, such as in a 4-methylphenyl, 4-hydroxymethylphenyl, or 4-(2-hydroxyethyl)phenyl (also referred to as a phenethylalcohol) group, etc., or aralkyl groups attached at the benzylic (alkyl) position such as found in a phenylmethyl or 4-hydroxyphenyl methyl group, at the 2-position in a phenethyl or 4-hydroxyphenethyl group, etc. In an example embodiment, the derivatized nanoparticle is diamond functionalized with a benzyl, 4-hydroxybenzyl, phenethyl, 4-hydroxyphenethyl, 4-hydroxymethylphenyl, or 4-(2-hydroxyethyl)phenyl group, or a combination thereof.

In one embodiment, nanoparticles 16 are further derivatized by grafting certain polymer chains to the functional groups. For example, polymer chains such as acrylic chains having carboxylic acid functional groups, hydroxy functional groups, or amine functional groups; polyamines such as polyethyleneamine or polyethyleneimine; poly(alkylene glycols) such as poly(ethylene glycol) or poly(propylene glycol); etc. may be included by reaction with functional groups. In some embodiments, the nanoparticles 16 include diamond cores derivatized to have metal atoms connected thereto.

In some embodiments, the nanoparticles 16 have one or more anionic functional groups such as sulfonic acid groups, carboxyl groups, phosphoric acid groups, phosphorous acid groups, phosphinic acid groups, or a combination thereof. When the nanoparticles 16 are functionalized with an anionic group, the nanoparticles 16 may also include one or more cationic functional groups, wherein a number of cationic functional groups is larger than a number of anionic functional groups. In such embodiments, the nanoparticles 16 have net positive charges, and therefore move toward the substrate 14 (cathode).

In another embodiment, the nanoparticles 16 have a basic or cationic functional group. Basic functional groups include, for example, primary amino groups, secondary amino groups, tertiary amino groups, and combinations thereof. Cationic functional groups include, for example, quaternary ammonium groups, quaternary phosphonium groups, tertiary sulfonium groups, alkyl pyridinium groups, and combinations thereof. In an embodiment, the nanoparticles 16 have a cationic functional group containing a primary amine (—$NH_2$), secondary amine (—NHR, where R may be, for example, an alkyl or aryl group), tertiary amine (—$NR_2$, where each R may be the same or different group, for example, an alkyl or aryl group), or a combination thereof. Examples of such functional groups include aminoethyl, dimethylaminoethyl, diethylaminoethyl, guanidinium, imidazolium, and similar groups. Nanoparticles 16 with cationic functional groups may include a counter ion (host ion) associated with the cationic functional group such as hydroxide, halide, sulfate, etc.

In an embodiment, the nanoparticles 16 may have an ionic polymer disposed on surfaces thereof. The ionic polymer may be a reaction product of an ionic liquid that includes a cation and an anion. A reaction that produces the reaction product may include, for example, polymerization of monomers of the ionic liquid.

In the deposition fluid 22, the nanoparticles 16 and metal ions 18 are typically disposed in an aqueous or nonaqueous fluid.

Ionic liquids are liquids that are exclusively or almost exclusively ions. Ionic liquids differ from so-called molten salts in that molten salts are typically corrosive and require extremely high temperatures to form a liquid due to ionic bond energies between ions in a salt lattice. For example, the melting temperature of the face-centered cubic crystal sodium chloride is greater than 800° C. In comparison, many ionic liquids are in a liquid phase below 100° C.

Figure 3A:
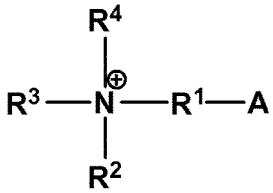
FIGS. 3A and 3B illustrate chemical formulas of ionic liquids that may be used to form coatings on substrates.
Figure 3A:
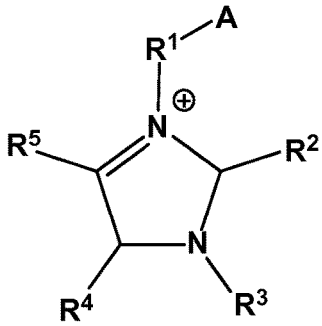
Figure 3A:
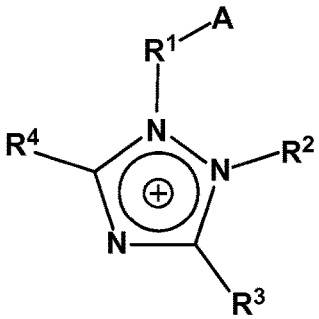
Figure 3A:
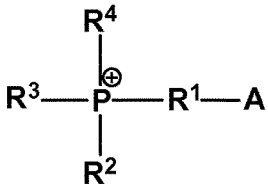
Figure 3A:
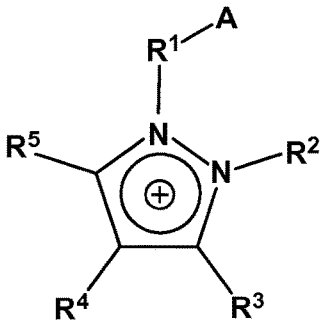
Figure 3A:
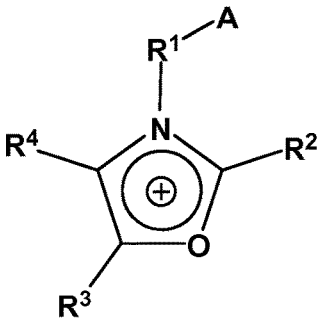
Figure 3A:
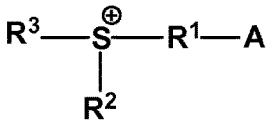
Figure 3A:
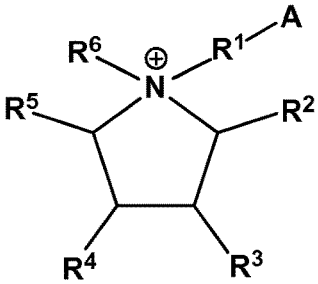
Figure 3A:
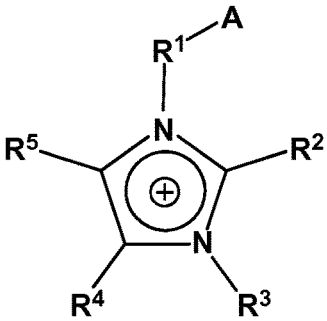
Figure 3A:
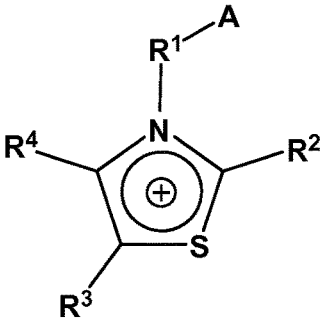
Figure 3B:
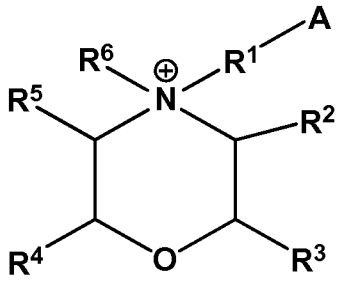
Figure 3B:
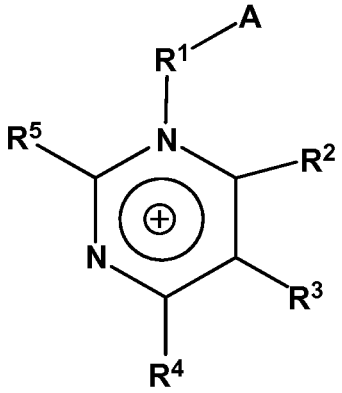
Figure 3B:
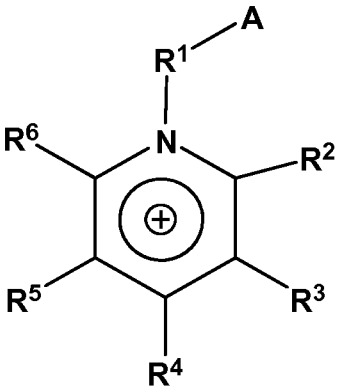
Figure 3B:
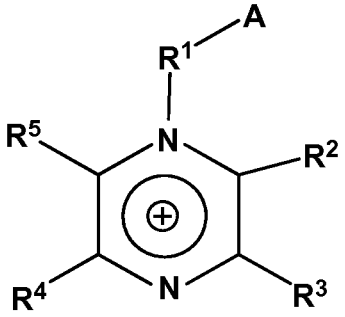
Figure 3B:
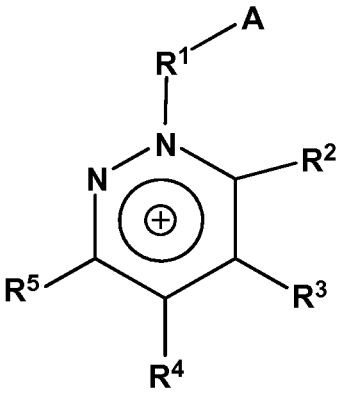

In some embodiments, an ionic liquid may include a cation having any of formulas (1) through (15), shown in FIGS. 3A and 3B, wherein A is hydrogen, an alkyl group, hydroxy, an amine, an alkoxy, an alkenyl group, or a polymerizable group; $R^1$ is a bond (e.g., a single bond, double bond, etc.) or any biradical group such as alkylene, alkyleneoxy, cycloalkylene, alkenylene, alkynylene, arylene, aralkylene, aryleneoxy, which is unsubstituted or substituted with a heteroatom or halogen; $R^2$, $R^3$, $R^4$, $R^5$, and $R^6$ are independently hydrogen, alkyl, alkyloxy, cylcloalkyl, aryl, alkaryl, aralkyl, aryloxy, aralkyloxy, alkenyl, alkynyl, amine, alkyleneamine, aryleneamine, hydroxy, carboxylic acid group or salt, halogen, which is unsubstituted or substituted with a heteroatom or halogen.

In an embodiment, the polymerizable group A includes an α,β-unsaturated carbonyl group (e.g., an acryl group or methacryl group), α,β-unsaturated nitrile group, alkenyl group (e.g., a conjugated dienyl group), alkynyl group, vinyl carboxylate ester group, carboxyl group, carbonyl group, epoxy group, isocyanate group, hydroxyl group, amide group, amino group, ester group, formyl group, nitrile group, nitro group, or a combination comprising at least one of the foregoing.

Ionic liquids with a polymerizable group A may provide a positive charge to the nanoparticles 16 through, e.g., covalent modification of the nanoparticles 16 with the ionic liquid or by polymerization of the ionic liquid on the surface of the nanoparticles 16. In some embodiments, deposition of a coating 26 includes using the ionic liquid to supply positive charge to the nanoparticles 16 without involving the transfer of protons $H^+$. Binding the nanoparticles 16 to an ionic liquid may provide stability to the deposited coatings 26 because bound ionic liquid may anchor and support the nanoparticles 16 in the metal 30. In some embodiments, the ionic liquid may be an aprotic non-aqueous solvent without the A group being a polymerizable group; for example, A may be hydrogen. Without being bound to any particular theory, polymerization of the ionic liquid appears to generally increase its viscosity and decrease its cationic mobility. Thus, in some embodiments, polymerizable ionic liquids are used to supply positive charge to the nanoparticles 16, e.g., for surface treatment of the nanoparticles 16, and in some embodiments, non-polymerizable ionic liquids are used as a solvent. In some embodiments, positive charge supplied to the nanoparticles 16 by the polymerizable ionic liquid may prevent aggregation of the nanoparticles 16 in solution and make the nanoparticles 16 more responsive to electric fields, such that the nanoparticles 16 can move toward the substrate 14 (cathode). Furthermore, non-polymerizable ionic liquids may be used as a solvent or an electrolyte to widen the electrochemical window of the solvent (i.e., the voltage range between which the solvent or electrolyte is neither oxidized nor reduced), and enable the use of higher voltage ranges during the electroplating process. Polymerizable and non-polymerizable ionic liquids may be used simultaneously, one to supply positive charge, and the other to function as a solvent. Ionic liquids may be selected as solvents instead of water, such as when coating a substrate that would react with water, for example, a magnesium alloy.

Cations of the ionic liquid may include, for example, imidazolium, pyrazolium, pyridinium, ammonium, pyrrolidinium, sulfonium, phosphonium, morpholinium, derivatives thereof, or a combination comprising at least one of the foregoing.

Anions of the ionic liquid are not particularly limited as long as the anions do not interfere with polymerization of the ionic liquid or dispersal of the nanoparticles 16. Non-limiting examples of the anion include halides (e.g., fluoride, chloride, bromide, iodide), tetrachloroaluminate ($AlCl_4^-$), hexafluorophosphate ($PF_6^-$), hexafluoroarsenate ($AsF_6^-$), tetrafluroborate ($BF_4^-$), triflate ($CF_3SO_3^-$), mesylate ($CH_3SO_3^-$), dicyanamide ($(NC)_2N^-$), thiocyanate ($SCN^-$), alkylsulfate ($ROSO_3^-$, wherein R is a halogentated or non-halogenated linear or branched alkyl group, e.g., $CH_3CH_2OSO_3^-$), tosylate, bis(trifluoromethyl-sulfonyl) imide, alkyl sulfate ($ROSO_3^-$, where R is a halogentated or non-halogenated linear or branched alkyl group, e.g., $CF_2HCH_2OSO_3^-$), alkyl carbonate ($ROCO_2^-$, where R is a halogentated or non-halogenated linear or branched alkyl group), and combinations including at least one of the foregoing.

For example, an ionic liquid may have a cation of formula (7), as shown in FIG. 3A, with A being an alkenyl group, $R^1$ being a bond or bivalent radical, and $R^2$ through $R^5$ each being an alkyl group or hydrogen. The ionic liquid may include a tetrafluoroborate anion. Particularly, the ionic liquid may have a cation of formula (7) with A being an alkenyl group, $R^1$ being a bond or bivalent radical, $R^3$ being an alkyl group, and $R^2$, $R^4$, and $R^5$ being hydrogen; the anion of the ionic liquid may be tetrafluoroborate.

Examples of ionic liquids include, but are not limited to, 3-ethyl-1-vinylimidazlium tetrafluoroborate, 1-methyl-3-vinylimidazolium methyl carbonate, 1-isobutyl-3-methylimidazolium tetrafluoroborate, 1-allyl-3-methylimidazolium bis(trifluoromethylsulfonyl)imide, 1-allyl-3-methylimidazolium bromide, 1,3-bis(cyanomethyl)imidazolium bis(trifluoromethylsulfonyl)imide, 1-ethyl-nicotinic acid ethyl ester ethylsulfate, 1-butyl-nicotinic acid butyl ester bis[(trifluoromethyl)sulfonyl]imide, 1-(3-cyanopropyl)-3-methylimidazolium bis(trifluoromethylsulfonyl)amide, 1,3-diallylimidazolium bis(trifluoromethylsulfonyl)imide, ethyl-dimethyl-(cyanomethyl)ammonium bis(trifluoromethylsulfonyl)imide, 3-[4-(acryloyloxy)butyl]-1-methyl-1H-imidazol-3-ium hexafluorophosphate, 1-methyl-3-{3-[(2-methylacryloyl)oxy]propyl}-1H-imidazol-3-ium bromide, and 3-ethenyl-1-ethyl-1H-imidazol-3-ium bis(trifluoromethylsulfonyl)imide. According to an embodiment, the ionic liquid that is used as a solvent includes aluminum chloride-1-ethyl-3-methylimidazolium chloride ($AlCl_3$-EMIC); aluminum chloride-N-(n-butyl)pyridinium chloride ($AlCl_3$-BPC); 1-butyl-1-methylpyrrolidinium bis (trifluoromethylsulfonyl)amide (BMPTFSA); 1-butyl-3-methylimidazolium chloride; 1-butyl-3-methylimidazolium bis(trifluoromethylsulfonyl)imide; 1-butyl-3-methylimidazolium dicyanamide etc.

In an embodiment, if the deposition fluid 22 is a non-aqueous fluid, the ionic liquid may be a solvent. The ionic liquid may fox in an ionic polymer on the nanoparticles 16. In some embodiments, the ionic liquid is a solvent in electrodeposition of a non-noble metal. Because hydrogen gas evolves at a higher potential than a deposition potential of aluminum and its alloys, conventional electrodeposition of aluminum in an aqueous solution is largely infeasible. However, the ionic liquid herein provides electrodeposition of such non-noble metals in a controlled manner.

Ionic liquids as described herein are generally available, such as from Sigma-Aldrich of St. Louis, Mo. Ionic liquids may also be synthetically prepared. Examples of syntheses include reacting an alkyl tertiary amine having a polymerizable group with an alkyl halide to obtain quaternarization of a nitrogen, then performing an exchange reaction with a desired anion. Alternatively, by reacting, for example, a tertiary amine with methyl p-tosylate, the anion can be concurrently introduced with quaternarization. A further alternative synthesis includes, for example, reacting a compound such as 2-chloroethanol with an N-alkylimidazole or pyridine to form an imidazolium salt or a pyridinium salt, reacting the salt with (meth)acryloyl chloride, and performing an exchange reaction with a desired anion. Yet another alternative is reacting an N-alkylimidazole or pyridine with 2-((meth)acryloylethyl) chloride and then carrying out an exchange reaction with a desired anion.

In some embodiments, the nanoparticles 16 and the ionic liquid are combined to form the deposition fluid 22.

In an embodiment, the deposition fluid 22 further includes a buffer, a surfactant, solvent, or a combination thereof. The buffer may be included to control the pH of the deposition fluid 22 or to mediate the pH during the formation or deposition of the coating 26. Moreover, the solubility of the metal 30 formed from the metal ions 18 of the deposition fluid 22 may depend on the pH of the deposition fluid 22. Examples of buffers include alkali salts of weak acids such as formic acid, acetic acid, citric acid, etc.; sulfonic acids; boric acid; etc. The deposition fluid 22 may be aqueous and have a pH of less than or equal to 7, less than or equal to 6, less than or equal to 5, from 2 to 6, or from 3 to 5.

The surfactant may be included in the deposition fluid 22 to disperse the nanoparticles 16. Useful surfactants include fatty acids (e.g., fatty acids having up to 22 carbon atoms), such as stearic acids and esters and polyesters thereof, poly(alkylene glycols) such as poly(ethylene oxide), poly (propylene oxide), and block and random poly(ethylene oxide-propylene oxide) copolymers such as those currently available from BASF SE, of Ludwigshafen, Germany, under the trademark PLURONIC®. Other surfactants include polysiloxanes, such as homopolymers and copolymers of poly(dimethylsiloxane), including those having functionalized end groups, etc. Other useful surfactants include those having a polymeric dispersant having poly(alkylene glycol) side chains, fatty acids, or fluorinated groups such as perfluorinated $C_{1-4}$ sulfonic acids grafted to the polymer backbone. Polymer backbones include those based on a polyester, a poly(meth)acrylate, a polystyrene, a poly(styrene-(meth)acrylate), a polycarbonate, a polyamide, a polyimide, a polyurethane, a polyvinyl alcohol, or a copolymer comprising at least one of these polymeric backbones. Additionally, the surfactant can be anionic, cationic, zwitterionic, or non-ionic.

Examples of cationic surfactants include, but are not limited to, alkyl primary, secondary, and tertiary amines, alkanolamides, quaternary ammonium salts, alkylated imidazolium, and pyridinium salts. Additional examples of the cationic surfactant include primary to tertiary alkylamine salts such as, for example, monostearylammonium chloride, distearylammonium chloride, tristearylammonium chloride; quaternary alkylammonium salts such as monostearyltrimethylammonium chloride, distearyldimethylammonium chloride, stearyldimethylbenzylammonium chloride, or monostearyl-bis(polyethoxy)methylammonium chloride; alkylpyridinium salts such as N-cetylpyridinium chloride or N-stearylpyridinium chloride; N,N-dialkylmorpholinium salts; fatty acid amide salts such as polyethylene polyamine; etc.

Examples of anionic surfactants include alkyl sulfates, alkyl sulfonates, fatty acids, sulfosuccinates, and phosphates. Examples of an anionic surfactant include anionic surfactants having a carboxyl group such as sodium salt of alkylcarboxylic acid, potassium salt of alkylcarboxylic acid, ammonium salt of alkylcarboxylic acid, sodium salt of alkylbenzenecarboxylic acid, potassium salt of alkylbenzenecarboxylic acid, ammonium salt of alkylbenzenecarboxylic acid, sodium salt of polyoxyalkylene alkyl ether carboxylic acid, potassium salt of polyoxyalkylene alkyl ether carboxylic acid, ammonium salt of polyoxyalkylene alkyl ether carboxylic acid, sodium salt of N-acylsarcosine acid, potassium salt of N-acylsarcosine acid, ammonium salt of N-acylsarcosine acid, sodium salt of N-acylglutamic acid, potassium salt of N-acylglutamic acid, ammonium salt of N-acylglutamic acid; anionic surfactants having a sulfonic acid group; anionic surfactants having a phosphonic acid; etc.

Nonionic surfactants may include, e.g., ethoxylated fatty alcohols, alkyl phenol polyethoxylates, fatty acid esters, glycerol esters, glycol esters, polyethers, alkyl polyglycosides, amineoxides, or a combination thereof. Examples of nonionic surfactants include fatty alcohols (e.g., cetyl alcohol, stearyl alcohol, cetostearyl alcohol, oleyl alcohol, etc.); polyoxyethylene glycol alkyl ethers (e.g., octaethylene glycol monododecyl ether, pentaethylene glycol monododecyl ether, etc.); polyoxypropylene glycol alkyl ethers (e.g., butapropylene glycol monononyl ether); glucoside alkyl ethers (e.g., decyl glucoside, lauryl glucoside, octyl glucoside); polyoxyethylene glycol octylphenol ethers (e.g., TRITON® X-100 (octyl phenol ethoxylate)); polyoxyethylene glycol alkylphenol ethers (e.g., nonoxynol-9); glycerol alkyl esters (e.g., glyceryl laurate); polyoxyethylene glycol sorbitan alkyl esters (e.g., polysorbates such as sorbitan monolaurate, sorbitan monopalmitate, sorbitan monostearate, sorbitan tristearate, sorbitan monooleate, etc.); sorbitan alkyl esters (e.g., polyoxyethylene sorbitan monolaurate, polyoxyethylene sorbitan monopalmitate, polyoxyethylene sorbitan monostearate, polyoxyethylene sorbitan monooleate, etc.); cocamide ethanolamines (e.g., cocamide monoethanolamine, cocamide diethanolamine, etc.); amine oxides (e.g., dodecyldimethylamine oxide, tetradecyldimethylamine oxide, hexadecyl dimethylamine oxide, octadecylamine oxide, etc.); block copolymers of polyethylene glycol and polypropylene glycol (e.g., poloxamers currently available under the trademark PLURONICS®, available from BASF); polyethoxylated amines (e.g., polyethoxylated tallow amine); polyoxyethylene alkyl ethers such as polyoxyethylene stearyl ether; polyoxyethylene alkylene ethers such as polyoxyethylene oleyl ether; polyoxyalkylene alkylphenyl ethers such as polyoxyethylene nonylphenyl ether; polyoxyalkylene glycols such as polyoxypropylene polyoxyethylene glycol; polyoxyethylene monoalkylates such as polyoxyethylene monostearate; bispolyoxyethylene alkylamines such as bispolyoxyethylene stearylamine; bispolyoxyethylene alkylamides such as bispolyoxyethylene stearylamide; alkylamine oxides such as N,N-dimethylalkylamine oxide; etc.

Zwitterionic surfactants (which include a cationic and anionic functional group on the same molecule) include, for example, betaines, such as alkyl ammonium carboxylates (e.g., $[(CH_3)_3N^+—CH(R)COO^-]$ or sulfonates (sulfo-betaines) such as $[RN^+(CH_3)_2(CH_2)_3SO_3^-]$, wherein R is an alkyl group). Other examples include n-dodecyl-N-benzyl-N-methylglycine $[C_{12}H_{25}N^+(CH_2C_6H_5)(CH_3)CH_2COO^-]$, N-allyl N-benzyl N-methyltaurines $[C_nH_{2n+1}N^+(CH_2C_6H_5)(CH_3)CH_2CH_2SO_3^-]$.

Solvents in the deposition fluid 22 may include aqueous or organic solvents. For example, solvents in the deposition fluid 22 may include water, alcohols (e.g., methanol, ethanol, isopropanol, etc.), dimethylsulfone, acetone, acetates, dimethsulfoxide, dimethylformamide, γ-butyrolactone, tetrahydrofuran, propylene carbonate, ethylene glycol, ethers, aromatic solvents (e.g., benzene, toluene, p-xylene, ethylbenzene, etc.), or combinations of one or more of the foregoing. The solvent may be selected based on the constituents of the deposition fluid 22, considering the properties of the constituents (e.g., solubility, compatibility, etc.).

In addition to the metal ions 18 and the nanoparticles 16, the deposition fluid 22 may include a reducing agent. For example, the reducing agent may reduce metal ions from the metal ions 18 to produce the metal 30 (FIG. 1), e.g., during deposition of the metal 30 on the substrate 14.

In embodiments in which an anode 12 is used (e.g., as shown in FIG. 2), the anode 12 may have a shape that complements or corresponds to the shape of the substrate 14 to mediate the current density and, thus, coating thickness. In an embodiment, the anode 12 has a different shape than the substrate 14.

In an embodiment, the nanoparticles 16 are present in the deposition fluid 22 in an amount from 0.001 wt % to 10 wt %, such as from 0.1 wt % to 10 wt %, or from 0.1 wt % to 5 wt %, based on the weight of the nanoparticles 16 and the metal material in the deposition fluid 22. The nanoparticles 16 may be present in the coating 26 in an amount from 0.001 wt % to 10 wt %, such as from 0.1 wt % to 10 wt %, or from 0.1 wt % to 5 wt %, based on the weight of the nanoparticles 16 and the metal 30 in the coating 26. In an embodiment, a ratio of a number of moles of the metal material to a number of moles of the ionic liquid in the deposition fluid 22 is greater than or equal to 1, such as greater than or equal to 1.5, or greater than or equal to 3.

Additives such as buffers, surfactants, reducing agents etc., described above, may be present in the deposition fluid 22 in an amount from 0 wt % to about 20 wt %, based on the weight of the deposition fluid 22, such as 0 wt % to about 10 wt %, or 0 wt % to about 5 wt %.

The metal 30 may be present in the coating 26 in an amount from about 80 wt % to about 99.999 wt %, based on the weight of the nanoparticles 16 and the metal 30 in the coating 26, such as from about 90 wt % to about 99.9 wt %, or from about 95 wt % to about 99.9 wt %.

In an embodiment, the applied voltage is a direct current (DC) voltage. In some embodiments, the applied voltage is a pulsed voltage. This potential difference may be selected to be great enough to reduce the metal material to produce the metal 30 for deposition on the substrate 14. According to an embodiment, the potential difference is selected based on the metal to be produced in the reduction, e.g., 1.5 volts (V) for the $Ni^{2+}$ from the metal material $NiCl_2$ to produce elemental nickel as in the half-reaction $Ni^{2+}+2\ e^{-}\rightarrow Ni^{0}$. In an embodiment, the potential difference may be from 0 V to about 100 V, such as from 0 V to about 50 V, 0 V to about 10 V, 0 V to about 5 V, or even 0 V to about 2 V. The current density at the substrate 14 may be from about 0.5 amps per square decimeter ($A/dm^2$) to about 100 $A/dm^2$, such as from about 0.5 $A/dm^2$ to about 50 $A/dm^2$, or from about 1 $A/dm^2$ to about 20 $A/dm^2$. In an embodiment in which a nonaqueous fluid is used, the current density may be from about 20 $A/dm^2$ to about 50 $A/dm^2$.

In an embodiment, the applied voltage is synchronously or asynchronously pulsed between a first potential and a second potential. Further, the pulse width may be from about 500 ns to infinity (i.e., continuous), such as from about 500 ns to about 30 seconds, from about 500 ns to about 1 second, or from about 1 μs to about 1 second. The pulse frequency may be from about 0.1 hertz (Hz) to about 100 megahertz (MHz), such as from about 1 Hz to about 20 MHz, or from about 10 Hz to about 10 (kilohertz) kHz. In such an embodiment, the pulsed current density may be from about 0.5 amps per square decimeter ($A/dm^2$) to about 100 $A/dm^2$, such as from 0.5 $A/dm^2$ to about 50 $A/dm^2$, or from about 1 $A/dm^2$ to about 20 $A/dm^2$. The polarity of the first potential may be positive or negative with respect to the second potential (i.e., the bias at the anode 12). According to an embodiment, the applied voltage can be pulsed between a non-zero and a zero value or between two different non-zero values (e.g., non-zero values of the same magnitude but opposite polarities). In an embodiment, an equal number of positive and negative voltage pulses are used in a given cycle during pulsing of the first potential. The pulse shape of the pulsed potentials (first potential or second potential) may be constant (i.e., no pulse), square (or rectangular), triangular, sawtooth, sinusoidal, etc. The duty cycle of the first potential or the second potential may be from about 0.1% to about 100%, such as from about 1% to about 75%, from about 1% to about 50%, or even from about 5% to about 50%.

Figure 4:
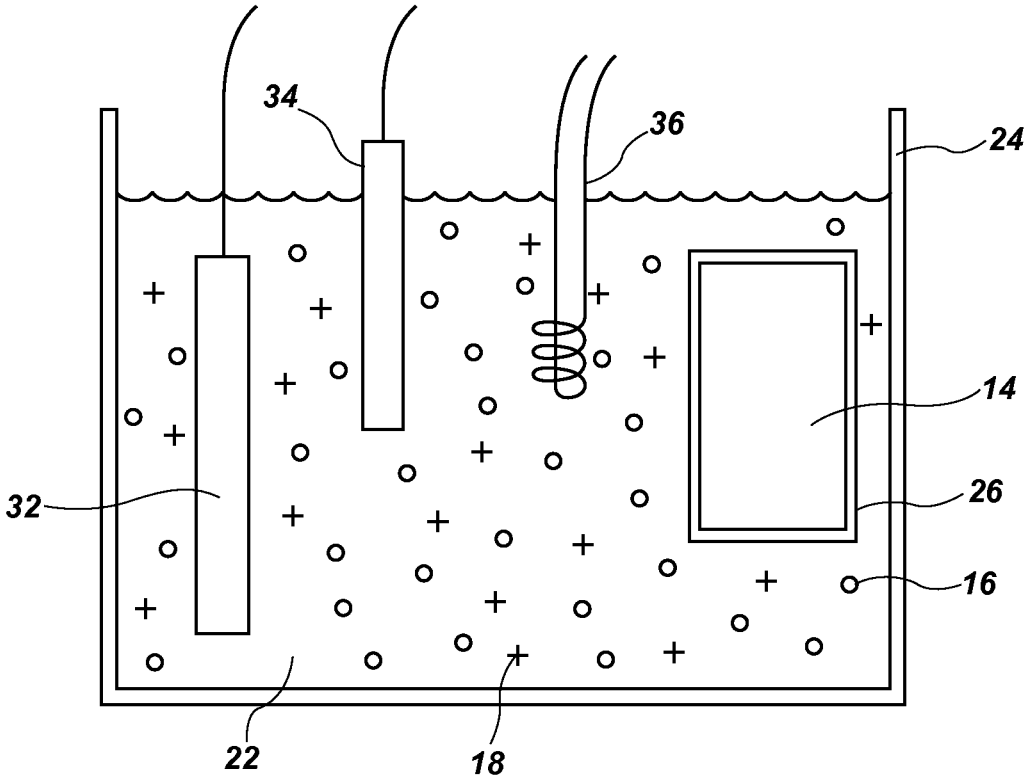
FIG. 4 is a simplified cross-sectional side view illustrating a method of forming a coating on a substrate by electroless deposition.

According to an embodiment, and as illustrated in FIG. 4, the deposition of the coating 26 on the substrate 14 may be electroless where an anode 12 (FIG. 2) is not present. In such embodiments, the deposition fluid 22 may additionally include a reducing agent as described above, e.g., to reduce the cationic metal species in the metal material for deposition of the metal 30 on the substrate 14. In another embodiment, the anode 12 is present but the first potential and the second potential are the same or their difference is below a potential at which reduction of the metal cation occurs so that reduction of the metal cation occurs in the deposition fluid 22 between the metal material and the reducing agent.

In an electroless deposition process as shown in FIG. 4, a reference electrode 32 may be disposed in the container 24. Additionally, a suitable pH monitor 34 (e.g., an electronic pH monitor, litmus paper, an acid-base indicator, etc.) may be used to monitor the pH of the deposition fluid 22. The temperature of the electrodeposition configuration (e.g., as in FIGS. 2 and 4) may be monitored and/or controlled via a temperature sensor or controller 36, such as thermocouple, resistance temperature detector, infrared detector, heating element, cooling element, etc. Any or all of these devices may also be used in conjunction with an electroplating process (FIG. 2) or electroless deposition (FIG. 4).

The pH of the deposition fluid 22 may be maintained in a range from about 2 to about 6, from about 2 to about 5, or from about 3 to about 5 during deposition of the coating 26 on the substrate 14. The temperature of the electrodeposition configuration or component(s) thereof may be maintained in a range from about 15° C. to about 90° C., such as from about 20° C. to about 90° C., or from about 20° C. to about 80° C. Deposition may occur at any selected pressure, including atmospheric pressure, sub-atmospheric pressure (i.e., under a vacuum condition), or at greater than atmospheric pressure.

During deposition of the nanoparticles 16 and metal 30 (see FIG. 1) on the substrate 14 to form the coating 26, the nanoparticles 16 may follow the applied electric field to the substrate 14. In some embodiments, the nanoparticles 16 have a positive net charge in a certain pH range. Consequently, the pH of the deposition fluid 22 may be altered to alter the charge density on the nanoparticles 16 or change the polarity of the charge on the nanoparticles 16. Changing the charge density on the nanoparticles 16 may change the number density of the nanoparticles 16 in the growing coating 26 (i.e., number of nanoparticles 16 per unit volume of coating 26) by varying the relative deposition rate of the nanoparticles 16 with respect to the metal 30.

In some embodiments, the thickness of the substrate 14 may be in a range from several nanometers (nm) to several millimeters thick, such as greater than or equal to about 10 nm, greater than or equal to about 1 micrometer (μm), or even greater than or equal to about 20 centimeters (cm). According to an embodiment, the thickness of the coating 26 is at least about 10 μm, such as at least about 40 μm, or from about 50 μm to about 100 μm. In some embodiments, the thickness of the coating 26 is from about 1 μm to about 100 μm.

The nanoparticles 16 may be uniformly or non-uniformly distributed (e.g., in a gradient distribution) in the coating 26. For example, the number density of the nanoparticles 16 proximate to the substrate 14 may be less than the number density of the nanoparticles 16 distal to the substrate 14, with the number density of the nanoparticles 16 changing smoothly (i.e., linearly by distance from the substrate 14) in a gradient. In another embodiment, the number density of the nanoparticles 16 proximate to the substrate 14 is greater than the number density of the nanoparticles 16 distal to the substrate 14, with the number density of the nanoparticles 16 changing smoothly (i.e., linearly by distance from the substrate 14) in a gradient. If the number density of the nanoparticles 16 in the coating 26 varies by location in the coating 26, the number density may change abruptly instead of smoothly, e.g., monotonically with respect to distance from the substrate 14 or in a direction parallel to the surface of the substrate 14.

In some embodiments, the substrate 14 may be removed from the coating 26 to form an independent volume of nanoparticles 16 dispersed in a matrix of metal 30. Removal of the substrate 14 may be performed by, for example, dissolving the substrate 14, corroding the substrate 14, cutting the substrate 14 from the coating 26, burning the substrate 14, pulling the substrate 14 away from the coating 26, reacting the substrate 14 with another material, etc. According to an embodiment, the substrate 14 is a metal foil that may be dissolved, leaving the free-standing metal 30 comprising nanoparticles 16 disposed therein.

Operating parameters may be varied during deposition of the nanoparticles 16 and the metal 30 on the substrate 14. For example, the first potential, the type or concentration of the metal material, the size or concentration of nanoparticles 16, or any combination thereof may be varied to form the coating 26 on the substrate 14. In one embodiment, the coating 26 is a single layer having nanoparticles 16 substantially uniformly dispersed in the metal 30. In other embodiments, the coating 26 may include multiple layers having different compositions. Such a multilayer coating 26 may be formed, for example, by modulating the first potential or changing the rate of deposition of a component of the coating 26 (e.g., the nanoparticles 16 or metal 30).

The coating 26 is continuous or discontinuous and of variable or uniform thickness. In an embodiment, a portion of the substrate 14 is masked so that the coating 26 is formed to be discontinuous on the substrate 14 and, in particular, to be absent from the masked portion of the substrate 14. The mask may be removed or may remain on the substrate 14 after formation of the coating 26.

The coating 26 and the coated substrate have advantageous properties including hardness over coatings that contain only metals or metal with additives such as ceramic or non-planar shaped nanoparticles. The Vickers hardness of the coating 26 may be from about 400HV30 to about 850HV30, such as from about 500HV30 to about 800HV30. Moreover, the coating 26 may provide a decreased coefficient of friction (e.g., with respect to pure metal coating) from about 0.8 to about 0.1, such as from about 0.8 to about 0.2. The coating 26 may provide a robust barrier for gases and liquids, i.e., the coating 26 may exhibit low permeability for, e.g., sour gases or liquids, hydrocarbons, acids, bases, solvents, etc. The coating 26 may be abrasion-resistant, meaning that the coating 26 exhibits relatively less wear than the underlying substrate 14 when exposed to abrasive materials.

In some embodiments, the coating 26 (and a substrate 14 having a coating 26 thereon) may exhibit a compressive strength from about 50 kilopounds per square inch (ksi) to about 150 ksi; or a yield strength from about 30 ksi to about 100 ksi, such as from about 60 ksi to about 80 ksi. In an embodiment, an article comprising the coating 26 can include multiple components that are combined or interwork, e.g., a slip and tubular. The components of the article can have the same or different material properties, such as percent elongation, compressive strength, tensile strength, etc.

To further increase the strength of the coating 26, the coating 26 may be subjected to surface processing, including surface hardening. That is, a surface-hardened product of the coating 26 may be formed by subjecting the coating 26 to, e.g., carburizing, nitriding, carbonitriding, boriding, flame hardening, induction hardening, laser beam hardening, electron beam hardening, hard chromium plating, electroless nickel plating, thermal spraying, weld hardfacing, ion implantation, or any combination thereof.

The coating 26 may be applied to various substrates 14 and thus has a wide range of uses, particularly for wear applications in which a substrate without the coating 26 would otherwise be subjected to excessive wear, erosion, corrosion, abrasion, scratching, etc. In an embodiment, the substrate 14 is a part of a downhole tool, such as an electro-submersible pump, a frac pump (i.e., a high-pressure, high-volume pump used for hydraulic fracturing), a drill bit body, a downhole motor, a valve, a flow diverter, etc. The coating 26 may exhibit beneficial wear properties for components expected to be exposed to wear, erosion, or corrosion, such as components exposed to production fluids (which may carry sand or other solid materials).

Additional non-limiting example embodiments of the disclosure are described below.

Embodiment 1: A method of coating a substrate, comprising dispersing functionalized diamond nanoparticles in a fluid comprising metal ions to form a deposition composition; disposing a portion of the deposition composition over at least a portion of a substrate; and electrochemically depositing a coating over the substrate. The coating comprises the diamond nanoparticles and a metal formed by reduction of the metal ions in the deposition composition.

Embodiment 2: The method of Embodiment 1, wherein electrochemically depositing a coating over the substrate comprises forming a coating having a thickness of at least about 10 μm.

Embodiment 3: The method of Embodiment 2, wherein electrochemically depositing a coating over the substrate comprises forming a coating having a thickness in a range from about 50 μm to about 100 μm.

Embodiment 4: The method of any of Embodiments 1 through 3, wherein electrochemically depositing a coating over the substrate comprises continuously forming the coating over the surface of the substrate.

Embodiment 5: The method of any of Embodiments 1 through 4, wherein dispersing functionalized diamond nanoparticles in a fluid comprising metal ions comprises dispersing functionalized diamond nanoparticles having a particle size in a range from about 20 nm to about 1 μm.

Embodiment 6: The method of any of Embodiments 1 through 5, wherein electrochemically depositing a coating over the substrate comprises electroless deposition of the metal onto a surface of the substrate.

Embodiment 7: The method of any of Embodiments 1 through 5, wherein electrochemically depositing a coating over the substrate comprises electroplating the coating over the substrate.

Embodiment 8: The method of any of Embodiments 1 through 7, wherein disposing a portion of the deposition composition over at least a portion of a substrate comprises disposing a portion of the deposition composition over at least a portion of a substrate comprising an electrically conductive material.

Embodiment 9: The method of Embodiment 8, wherein disposing a portion of the deposition composition over at least a portion of a substrate comprising an electrically conductive material comprises disposing a portion of the deposition composition over at least a portion of a substrate comprising at least one material selected from the group consisting of aluminum, bismuth, boron, calcium, cobalt, copper, chromium, iron, lead, magnesium, manganese, molybdenum, nickel, niobium, nitrogen, phosphorous, selenium, sulfur, tantalum, tellurium, titanium, tungsten, vanadium, zirconium, silicon, zinc, a rare earth element, and combinations and alloys thereof.

Embodiment 10: The method of any of Embodiments 1 through 9, wherein disposing a portion of the deposition composition over at least a portion of a substrate comprises disposing a portion of the deposition composition over at least a portion of a substrate comprising an electrically nonconductive material.

Embodiment 11: The method of any of Embodiments 1 through 10, wherein dispersing functionalized diamond nanoparticles in a fluid comprising metal ions comprises dispersing the functionalized diamond nanoparticles in a fluid comprising a compound comprising the metal ions.

Embodiment 12: The method of any of Embodiments 1 through 11, wherein dispersing functionalized diamond nanoparticles in a fluid comprising metal ions comprises dispersing the functionalized diamond nanoparticles in a fluid comprising an ionic liquid having a cation having a formula selected from the group consisting of the formulas shown in FIGS. 3A and 3B. A is selected from the group consisting of hydrogen, an alkyl group, hydroxy, an amine, an alkoxy, an alkenyl group, and a polymerizable group. $R^1$ is selected from the group consisting of a bond and a biradical group. Each of $R^2$, $R^3$, $R^4$, $R^5$, and $R^6$ is independently selected from the group consisting of hydrogen, alkyl, alkyloxy, cylcloalkyl, aryl, alkaryl, aralkyl, aryloxy, aralkyloxy, alkenyl, alkynyl, amine, alkyleneamine, aryleneamine, hydroxy, carboxylic acid groups and salts, and halogens.

Embodiment 13: The method of any of Embodiments 1 through 12, further comprising covalently bonding one or more molecular groups to outer surfaces of a plurality of diamond nanoparticles to form the functionalized diamond nanoparticles.

Embodiment 14: The method of any of Embodiments 1 through 13, further comprising functionalizing diamond nanoparticles with at least one functional group selected from the group consisting of carboxy, epoxy, ether, ketone, amine, hydroxy, alkoxy, alkyl, aryl, aralkyl, alkaryl, lactone, functionalized polymeric and oligomeric groups, quaternary ammonium groups, quaternary phosphonium groups, tertiary sulfonium groups, alkyl pyridinium groups, primary amines (—$NH_2$), secondary amines (—NHR), tertiary amines (—$NR_2$), aminoethyl, dimethylaminoethyl, di ethylaminoethyl, guanidinium, imidazolium, and combinations thereof. Each R independently comprises an alkyl or aryl group.

Embodiment 15: The method of any of Embodiments 1 through 14, wherein electrochemically depositing a coating over the substrate comprises forming an abrasion-resistant coating over the substrate.

Embodiment 16: The method of Embodiment 10, wherein disposing a portion of the deposition composition over at least a portion of a substrate comprising an electrically nonconductive material comprises disposing a portion of the deposition composition over at least a portion of a substrate comprising at least one material selected from the group consisting of polymers, ceramics, and glass.

Embodiment 17: The method of Embodiment 10 or Embodiment 16, wherein disposing a portion of the deposition composition over at least a portion of a substrate comprising an electrically nonconductive material comprises disposing a portion of the deposition composition over a conductive material disposed over the nonconductive material.

Embodiment 18: A method of coating a substrate, comprising disposing a deposition fluid in a container, disposing a surface of a substrate in the container in contact with the deposition fluid, and electrochemically depositing a coating on the substrate. The deposition fluid comprises a plurality of functionalized diamond nanoparticles and a plurality of metal ions. The coating comprises a metal formed from the metal ions and the functionalized diamond nanoparticles.

Embodiment 19: The method of Embodiment 18, wherein the deposition fluid further comprises a buffer.

Embodiment 20: The method of Embodiment 18 or Embodiment 19, wherein the deposition fluid further comprises a surfactant.

Embodiment 21: The method of any of Embodiments 18 through 20, wherein the deposition fluid further comprises an ionic liquid.

Embodiment 22: A method of coating a substrate, comprising disposing a deposition fluid in a container, disposing at least a portion of a substrate in the container in contact with the deposition fluid, and electrochemically forming a coating on the substrate. The deposition fluid comprises a plurality of functionalized diamond nanoparticles, an ionic liquid, and metal ions. The coating comprises a metal formed from the metal ions and the functionalized diamond nanoparticles.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various substrate types and configurations.

What is claimed is:

1. A method of coating a substrate by electrodeposition, comprising:

dispersing functionalized diamond nanoparticles in an ionic liquid comprising cations and anions to form a deposition composition comprising the functionalized diamond nanoparticles dispersed within the ionic liquid, wherein the cations comprise metal ions, wherein the functionalized diamond nanoparticles comprise at least one functional group selected from the group consisting of carboxy, epoxy, ether, ketone, amine, hydroxy, alkoxy, alkyl, aryl, aralkyl, alkaryl, lactone, polymeric groups, oligomeric groups, quaternary ammonium groups, quaternary phosphonium groups, tertiary sulfonium groups, alkyl pyridinium groups, primary amines, secondary amines, tertiary amines, aminoethyl, dimethylaminoethyl, diethylaminoethyl, guanidinium, and imidazolium, the ionic liquid comprising a polymerizable group that provides a net positive charge to the functionalized diamond nanoparticles through covalent modification of the functionalized diamond nanoparticles with the ionic liquid or by polymerization of the ionic liquid on a surface of the functionalized diamond nanoparticles;

disposing a portion of the deposition composition over at least a portion of a substrate; and electrochemically depositing a coating over the substrate, the coating comprising the diamond nanoparticles and a metal formed by reduction of the metal ions in the deposition composition.

2. The method of claim 1, wherein electrochemically depositing a coating over the substrate comprises forming a coating having a thickness of at least about 10 μm.

3. The method of claim 2, wherein electrochemically depositing a coating over the substrate comprises forming a coating having a thickness in a range from about 50 μm to about 100 μm.

4. The method of claim 1, wherein electrochemically depositing a coating over the substrate comprises continuously forming the coating over the surface of the substrate.

5. The method of claim 1, wherein dispersing functionalized diamond nanoparticles in an ionic liquid comprising cations and anions comprises dispersing functionalized diamond nanoparticles having a particle size in a range from about 20 nm to about 1 μm.

6. The method of claim 1, wherein electrochemically depositing a coating over the substrate comprises electroless deposition of the metal onto a surface of the substrate.

7. The method of claim 1, wherein electrochemically depositing a coating over the substrate comprises electroplating the coating over the substrate, further comprising disposing an anode within deposition composition, the anode having a size and shape corresponding to a size and shape of the substrate.

8. The method of claim 1, wherein disposing a portion of the deposition composition over at least a portion of a substrate comprises disposing a portion of the deposition composition over at least a portion of a substrate comprising an electrically conductive material.

9. The method of claim 8, wherein disposing a portion of the deposition composition over at least a portion of a substrate comprising an electrically conductive material comprises disposing a portion of the deposition composition over at least a portion of a substrate comprising at least one material selected from the group consisting of aluminum, bismuth, boron, calcium, cobalt, copper, chromium, iron, lead, magnesium, manganese, molybdenum, nickel, niobium, nitrogen, phosphorous, selenium, sulfur, tantalum, tellurium, titanium, tungsten, vanadium, zirconium, silicon, zinc, a rare earth element, and combinations and alloys thereof.

10. The method of claim 1, wherein disposing a portion of the deposition composition over at least a portion of a substrate comprises disposing a portion of the deposition composition over at least a portion of a substrate comprising an electrically nonconductive material.

11. The method of claim 1, wherein dispersing functionalized diamond nanoparticles in an ionic liquid comprises dispersing functionalized diamond nanoparticles in a polymerizable ionic liquid and a non-polymerizable ionic liquid.

12. The method of claim 1, wherein dispersing functionalized diamond nanoparticles in an ionic liquid comprising cations and anions comprises dispersing the functionalized diamond nanoparticles in an ionic liquid having a cation having a formula selected from the group consisting of:

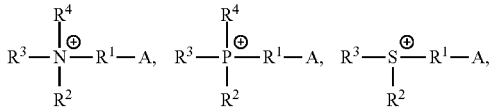

-continued

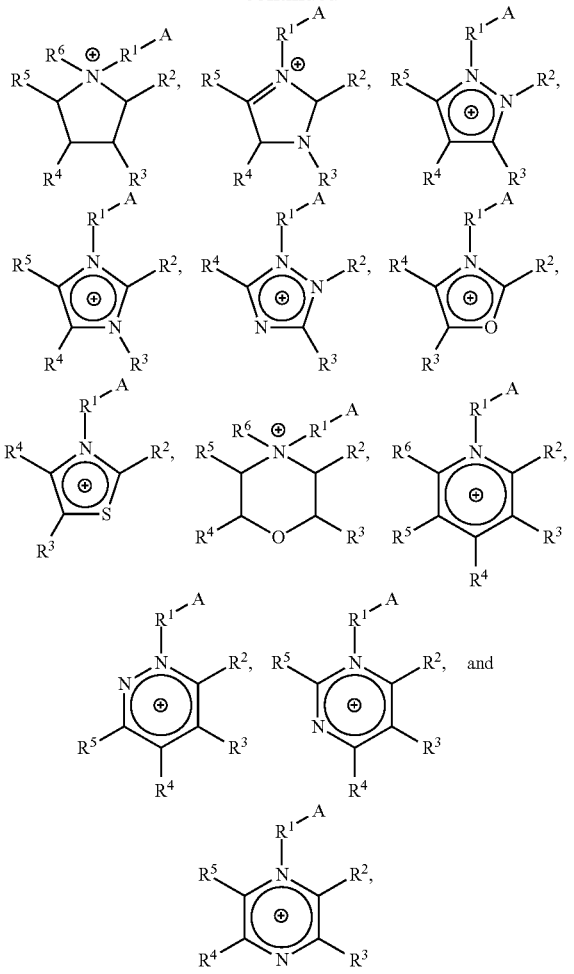

wherein:

A is selected from the group consisting of hydrogen, an alkyl group, hydroxy, an amine, an alkoxy, an alkenyl group, and a polymerizable group;

$R^1$ is selected from the group consisting of a bond and a biradical group; and each of $R^2$, $R^3$, $R^4$, $R^5$, and $R^6$ is independently selected from the group consisting of hydrogen, alkyl, alkyloxy, cylcloalkyl, aryl, alkaryl, aralkyl, aryloxy, aralkyloxy, alkenyl, alkynyl, amine, alkyleneamine, aryleneamine, hydroxy, carboxylic acid groups and salts, and halogens.

13. The method of claim 1, further comprising covalently bonding one or more molecular groups to outer surfaces of a plurality of diamond nanoparticles to form the functionalized diamond nanoparticles.

14. The method of claim 1, wherein electrochemically depositing a coating over the substrate comprises forming an abrasion-resistant coating over the substrate.

15. The method of claim 1, wherein:

dispersing functionalized diamond nanoparticles in an ionic liquid comprising cations and anions comprises dispersing functionalized diamond nanoparticles in an ionic liquid comprising aluminum ions; and electrochemically depositing a coating over the substrate comprises forming aluminum by reduction of the aluminum ions in the deposition composition.

16. The method of claim 1, wherein electrochemically depositing a coating over the substrate comprises depositing a coating over the substrate to have a higher number density of the functionalized diamond nanoparticles proximate the substrate than distal from the substrate.

17. A method of coating a substrate by electrodeposition, comprising:

disposing a deposition fluid in a container, the deposition fluid comprising:

a plurality of functionalized diamond nanoparticles, wherein the functionalized diamond nanoparticles comprise anionic functional groups and cationic functional groups, at least one functional group selected from the group consisting of carboxy, epoxy, ether, ketone, amine, hydroxy, alkoxy, alkyl, aryl, aralkyl, alkaryl, lactone, polymeric groups, oligomeric groups, quaternary ammonium groups, quaternary phosphonium groups, tertiary sulfonium groups, alkyl pyridinium groups, primary amines, secondary amines, tertiary amines, aminoethyl, dimethylaminoethyl, diethylaminoethyl, guanidinium, and imidazolium;

a plurality of anions;

a plurality of metal ions; and an ionic liquid comprising a polymerizable ionic liquid and a non-polymerizable ionic liquid;

disposing a surface of a substrate in the container in contact with the deposition fluid;

providing a net positive charge to the plurality of functionalized diamond nanoparticles through covalent modification of the functionalized diamond nanoparticles with the ionic liquid or by polymerization of the ionic liquid on a surface of the functionalized diamond nanoparticles; and electrochemically depositing a coating on the substrate, the coating comprising:

a metal formed from the metal ions; and the functionalized diamond nanoparticles.

18. The method of claim 17, wherein the deposition fluid further comprises a buffer.

* * * * *